United States Patent [19]

Varadi

[11] 4,139,228

[45] Feb. 13, 1979

[54] QUARTER-TURN LOCKING DEVICE

[75] Inventor: Thomas Varadi, Beersheba, Israel

[73] Assignee: Israel Aircraft Industries Ltd., Lod, Israel

[21] Appl. No.: 806,266

[22] Filed: Jun. 13, 1977

[51] Int. Cl.[2] ..... B66C 1/66

[52] U.S. Cl. ..... 294/83 R; 105/366 B; 105/465; 294/81 SF

[58] Field of Search ..... 294/67 R, 67 D, 67 DA, 294/67 DB, 81 SF, 83 R; 24/221 R; 105/366 E-366 D, 463, 464, 465, 473, 481; 248/119 R; 296/35 A; 403/252

[56] References Cited

U.S. PATENT DOCUMENTS

| | | | |
|---|---|---|---|
| 3,159,111 | 12/1964 | Gutridge et al. | 105/366 B |
| 3,438,671 | 4/1969 | Seng | 296/35 A |
| 4,026,596 | 5/1977 | Carr | 296/35 AA |

FOREIGN PATENT DOCUMENTS

| | | | |
|---|---|---|---|
| 2227430 | 1/1974 | Fed. Rep. of Germany | 294/81 SF |
| 1271299 | 4/1972 | United Kingdom | 294/81 SF |

*Primary Examiner*—Johnny D. Cherry

*Attorney, Agent, or Firm*—Benjamin J. Barish

[57] ABSTRACT

A locking device is described particularly useful for coupling a container to a crane, the locking device including a lock-pin assembly coupleable to the crane, and a slotted member fixed to the container into which member the lock-pin assembly may be inserted and then locked.

The slotted member is formed with an oval slot and a square cavity underlying and communicating with the slot and having a length and width at least equal to the length of the slot. The lock-pin assembly comprises a pin, an axial-stop element fixed to the inner end of the pin, and a rotary-stop element fixed to the inner end of the pin between the axial-stop element and the outer end of the pin. The lock-pin assembly further includes a handle at the outer end of the pin which handle enables the user to insert both stop elements of the pin assembly through the slot and into the cavity, to turn the assembly one-quarter turn, and to pull the assembly partially out of the slot until the axial-stop element engages the wall of the cavity and the rotary-stop element engages the walls of the slot.

10 Claims, 3 Drawing Figures

QUARTER-TURN LOCKING DEVICE

BACKGROUND OF THE INVENTION

The present invention relates to locking devices, and particularly to such devices which may be locked and unlocked by manually turning a pin a quarter-turn.

SUMMARY OF THE INVENTION

The invention provides a quarter-turn locking device including a lock-pin assembly and a slotted member into which the lock-pin assembly may be inserted and then locked. The slotted member is formed with a slot having a longer length than width, and a cavity underlying and communicating with the slot and having a length and width both at least equal to the length of the slot. The lock-pin assembly comprises a pin; an axial-stop element fixed to the inner end of the pin and having a length and width less than those of the slot, its length being greater than the width of the slot but less than the width of the cavity; and a rotary-stop element fixed to the inner end of the pin between the axial-stop element and the outer end of the pin, the rotary-stop element having a width no greater than, and a length substantially equal to, the width of the slot. The lock-pin assembly further includes a handle at the outlet end of the pin, which handle enables the user to insert both stop elements of the pin assembly through the slot and into the cavity, to turn the assembly one-quarter turn, and then to pull the assembly partially out of the slot until the axial-stop element engages the wall of the cavity and the rotary-stop element seats within and engages the walls of the slot.

Preferably, the device further includes locking means effective, when the axial-stop element engages the wall of the cavity and the rotary-stop element engages the walls of the slot, to lock the pin assembly against inward axial movement further into the cavity.

In the preferred embodiment of the invention described below, the handle is pivotably mounted to the lock pin assembly about an axis perpendicular to the axis of the pin, and the mentioned locking means comprises a first cam surface effective when the handle is in its initial position to permit the lock-pin assembly to be moved further into the cavity, and a second cam surface effective when the handle is in its pivotted position to lock the pin assembly against axial movement further into the cavity.

The invention is particularly useful for coupling a container to a lifting device, e.g. a crane. In such an arrangement, the slotted member is fixed to the container being handled, and the lock-pin assembly receives a hanger plate having an opening at one end received around the pin of the lock-pin assembly, and an ear at its opposite end for coupling to the crane.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENT

Figure 1:
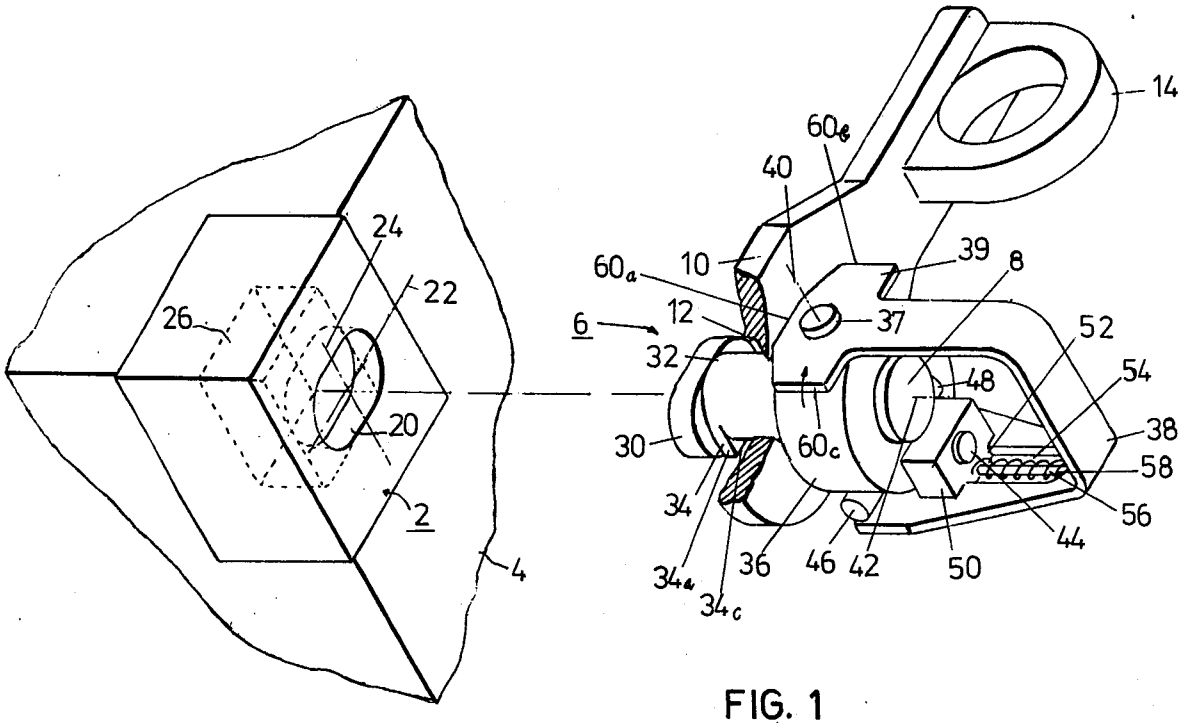
FIG. 1 is a three-dimensional view illustrating the two main parts of one form of locking device constructed in accordance with the invention.

The preferred embodiment of the invention described below relates to a locking device designed particularly for use in coupling a lifting device, e.g. a crane, to a container to enable the container to be handled by the lifting device.

The locking device illustrated in the drawings includes two main members, namely a slotted member or block 2 secured to the container 4 to be handled; and a lock-pin assembly, generally designated 6, having a locking pin 8 adapted to be inserted into the slotted member 2 and to be locked therein by turning the lock-pin assembly a quarter turn, and then making other manipulations which will be described more particularly below. A hanger plate 10 is formed at its lower end with an opening 12 rotatably receiving pin 8 of the locking assembly 6, the hanger plate including, at its opposite end, an ear 14 adapted to receive a coupling element of the lifting device (e.g. a hook on a crane, not shown). The arrangement is such that the lock-pin assembly 6 may be locked to the slotted member 2 fixed to the container 4 to enable the lifting device (not shown), by engaging ear 14 of hanger plate 10, to lift, convey, lower and otherwise handle the container.

Slotted member 2 is formed with a substantially oval slot 20 of generally rectangular shape but having curved (semi-circular) ends, the length (axis 22) of slot 20 being longer than its width (axis 24). In addition, member 2 is formed with a cavity 26 underlying and communicating with slot 20, the cavity being of substantially square configuration and having a length and width both substantially equal to the length (axis 22) of the slot 20.

Pin 8 of the lock-pin assembly 6 includes an axial-stop element 30 fixed to its inner end and having a length and width less than those of slot 20, the length of stop 30 being greater than the width of slot 20 but less than the width of cavity 26. In the illustrated embodiment, it will be seen that the axial-stop 30 is of substantially the same configuration as slot 20, but of slightly smaller dimensions, so that it can be freely inserted through the slot and into the cavity 26. Pin 8 further includes a second stop element 32 fixed to the inner end of the pin adjacent to the axial-stop element 30, between it and the outer end of the pin. Element 32 is a rotary-stop and has a length and width substantially equal to the width of slot 20. Stop 32 is formed with three flat edges **34*a*, 34*b*, 34*c* (FIG. 2), edges 34*a* and 34*b* being engageable with the opposed walls of slot 20**, after the lock-pin assembly has been rotated one-quarter turn, to lock the assembly against rotary movement as will be described more particularly below.

Figure 2:
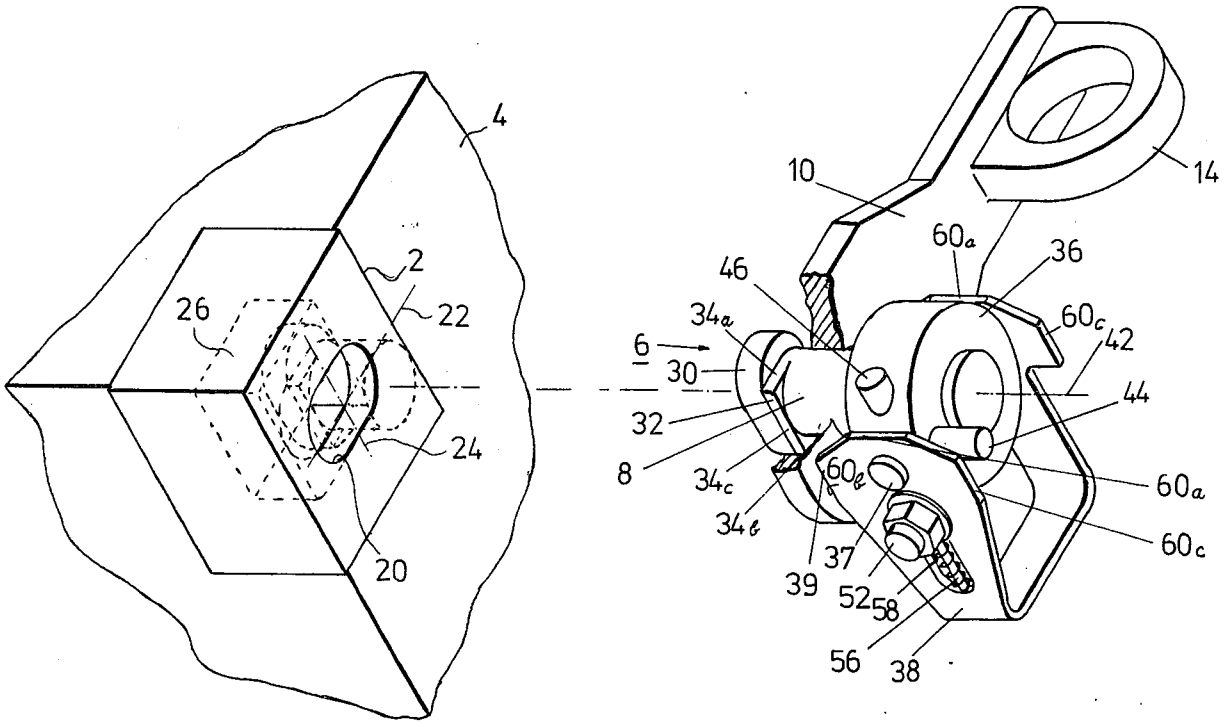
FIG. 2 is a three-dimensional view of the locking device of FIG. 1, the lock-pin assembly being shown in its locked position.

The opposite end of pin 8 in the lock-pin assembly 6 includes a ring 36 of larger diameter than pin 8 and having a pair of trunnions 37 pivotably mounting a U-shaped handle 38 along axis 40 extending transversely of the pin 8. Handle 38 may be pivotted on trunnions 37 from an initial or extended position, illustrated in FIG. 1, to one of two pivotted or folded positions, one of which is illustrated in FIG. 2. In its extended position (FIG. 1), handle 38 extends parallel to the longitudinal axis 42 of pin 8 enabling it to turn the pin, including its two stop elements 30, 32, about the pin axis 42. After the lock-pin assembly 6 has been inserted into the slotted member 2 and locked therein in the manner to be described below, the handle 38 may then be pivotted to its folded position (FIG. 2) in which it extends perpendicularly to the longitudinal axis 42 of pin 8.

The lock-pin assembly 6 further includes manually-releasable retaining means for retaining handle 38 either in its extended position (FIG. 1) or in one of its two folded positions (FIG. 2). The latter retaining means comprise three pegs 44, 46, 48, all secured to ring 36 on pin 8. These pegs cooperate with an apertured retainer member or block 50 slidable in handle 38, the block including a tongue 52 movable within a slot 54 formed in the handle. For purposes of guiding the movement of block 50, its tongue 52 is formed with an opening receiving a guiding rod 56 fixed to handle 38 and extending lengthwise of its slot 54. Retainer block 50 is spring-urged inwardly towards ring 36 on pin 8 by means of a coil spring 58 enclosing rod 56, one end of the spring bearing against tongue 52, and the opposite end bearing against the end wall of slot 54 in handle 38.

Retainer peg 44 is fixed to ring 36 on pin 8 and extends in the axial direction, i.e. parallel to the longitudinal axis 42 of the pin. The other two retainer pegs 46, 48 are fixed to the outer faces of ring 36 coaxial to each other and extend in the tangential direction, i.e. perpendicularly to the longitudinal axis 42 of pin 8 and also to pivot axis 40 of handle 38. Peg 44 is used for retaining handle 38 in its extended position (FIG. 1), and pegs 46, 48 are used for retaining the handle in one of its two folded positions (FIG. 2), depending on which direction the handle is pivotted along its pivot axis 40. The aperture in retainer block 50 is adapted to receive one of the three retainer pegs 44, 46 or 48, depending on the position of handle 38, whereby the handle is retained in position.

The ends of the U-shaped handle 38 pivotably mounted to trunnions 37 are of substantially T-shape configuration to provide three cam surfaces cooperable with hanger plate 10. Thus, these cam surfaces includes a central low flat edge 60*a* which comes into alignment with, but spaced from, hanger plate 10 in the extended (FIG. 1) position of the handle. The low flat edge 60*a* is straddled by two high flat edges 60*b*, 60*c* laterally of each handle end, one of which edges, in the folded position of the handle (FIG. 2), is adapted to firmly engage hanger plate 10, depending on which direction the handle is pivotted to its folded position, to thereby lock the pin assembly 6 against axial movement further into cavity 26 of member 2, as will be described more particularly below.

As indicated earlier, the locking device illustrated in the drawings may be used for coupling a lifting device (e.g., a crane) to a container 4 via a hanger plate 10 coupled to the container and engageable by the lifting device to permit the lifting device to lift, convey, and lower the container. When used for this purpose, the lock-pin assembly 6, including the hanger plate 10 received on pin 8, is applied to the slotted member 2 fixed to the container 4 in the following manner: First, the lock-pin assembly 8 is grasped by its handle 38, the latter being in its extended position as illustrated in FIG. 1, and the inner end of the assembly, including the two stop elements 30, 32, are inserted through slot 20 of member 2 and into its cavity 26. The lock-pin assembly is then rotated one-quarter turn in either direction (FIG. 2 illustrating it having been rotated one-quarter turn clockwise) until the two opposed straight edges 34*a*, 34*b* of the rotary stop element 34 are aligned with the opposed flat walls defining the width of slot 20. The lock-pin assembly 6 is then partially withdrawn (moved rightwardly in FIG. 2) until the axial-stop element 30 seats within and engages the walls of cavity 26 bordering slot 20; i.e., the two opposed flat edges 34*a*, 34*b* of the rotary-stop element 32 engage the opposed flat walls defining the width of slot 20.

Up to now, low cam edge 60*a* at each end of handle 38 is aligned with, but is spaced from, hanger plate 10, so that the hanger plate 10 can move axially with respect to the lock-pin assembly 6, and also with respect to the slotted member 2 carried by the container 4. Handle 38 is then pivotted on its trunnions 37 about axis 40 to the position illustrated in FIGS. 2 and 3, whereby the high flat cam edges 60*b* at the ends of handle 38 come into firm engagement with the hanger plate 10 thereby, among other things, preventing plate 10 from moving along axis 42 with respect to assembly 6.

Figure 3:
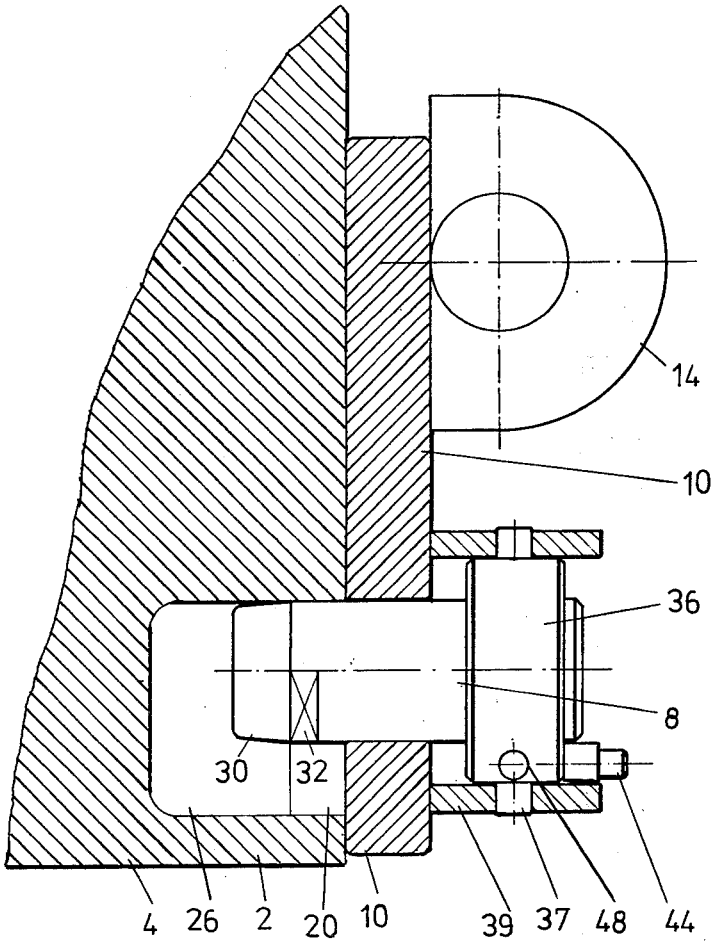
FIG. 3 is an enlarged transverse sectional view illustrating the locking device of FIG. 1 in its locked condition.

This is the position of the device illustrated in FIGS. 2 and 3, wherein it will be seen that the axial-stop element 30 engages the wall of cavity 26 bordering slot 20, thereby preventing the lock-pin assembly from moving axially outwardly of the cavity and the slot; the two flat edges 34*a*, 34*b* of the rotary stop element 32 engage the side walls of slot 20 defining its width along its axis 24, thereby locking the assembly from rotary movement within member 2; and the high flat cam edges 60*b* of handle 38 firmly engage hanger plate 10, thereby locking the assembly against inward movement further into cavity 26 of member 2. The lifting device (not shown) receivable within ear 14 of the hanger plate 10 may thus lift, convey, lower, and otherwise handle the container 4 to which the slotted member 2 is fixed.

When it is desired to decouple the lock-pin assembly 6 from slotted member 2 and its container 4, the above procedure is merely reversed. That is, handle 38 is pivotted to its extended position (FIG. 1) to thereby cause its low flat edge 60*a* to face hanger plate 10. Since this edge is spaced from the hanger plate, lock-pin assembly may be moved inwardly further into the cavity 26 of member 2 sufficiently to unseat the flat edges 34*a*, 34*b* of lock element 32 from the side walls of slot 20. As both lock elements 30, 32 are now within cavity 26 of the slotted member 2, the lock-pin assembly may be rotated one-quarter turn, until lock element 30 is aligned with slot 20, at which time it may be withdrawn from the slot.

While the invention has been described with respect to one preferred embodiment, it will be appreciated that many variations, modifications and other applications of the invention may be made.

What is claimed is:

1. A locking device including a lock-pin assembly and a slotted member into which the lock-pin assembly may be inserted and then locked; said slotted member being formed with a slot having a longer length than width, and a cavity underlying and communicating with said slot and having a length and width both at least equal to the length of said slot; said lock-pin assembly comprising a pin having inner and outer ends; an axial-stop element fixed to the inner end of the pin and having a length and width less than those of the slot to permit inserting same through the slot, the length of the axial-stop element being greater than the width of the slot but less than the width of the cavity; a rotary-stop element fixed to the inner end of the pin between the axial-stop element and the outer end of the pin, said rotary-stop element having a width no greater than, and a length substantially equal to, the width of the slot; and a handle at the outer end of the pin, said handle enabling the user to insert both said stop elements of the pin assembly through the slot and into the cavity, to turn the assembly one-quarter turn, and then to pull the assembly partially out of the slot until the axial-stop element engages the wall of the cavity and the rotary-stop element seats within and engages the walls of the slot.

2. A locking device according to claim 1, further including locking means effective, when the axial-stop element engages the wall of the cavity and the rotary-stop element engages the walls of the slot, to lock the pin assembly against inward axial movement further into the cavity.

3. A locking device according to claim 2, wherein said handle is pivotably mounted to the lock-pin assembly about an axis perpendicular to the axis of the pin, and wherein said locking means comprises a first cam surface effective when the handle is in its initial position to permit the lock-pin assembly to be moved further into the cavity, and a second cam surface effective when the handle is in its pivotted position to lock the pin assembly against the said axial movement further into the cavity.

4. A device according to claim 3, wherein said lock-pin assembly includes manually-releasable retaining means for retaining the pivotable handle in its initial and pivotted positions.

5. A device according to claim 4, wherein said retaining means comprises a pair of pegs fixed to the outer end of said pin, and an apertured member slidable on the handle, one of said pegs being fixed to the pin parallel to its longitudinal axis and adapted to receive said apertured member for locking the handle in its initial position, the other of said pegs being fixed to said pin perpendicular to its longitudinal axis, and also perpendicular to the pivot axis of the handle, and adapted to receive said apertured member for locking the handle in its pivotted position.

6. A device according to claim 5, wherein said handle is pivotable in either direction from its initial position to one of two pivotted positions, said handle including two of said second cam surfaces effective to lock the pin assembly against inward axial movement further into the cavity when the handle is pivotted to either of its pivotted positions; said retaining means including a third peg, two of which pegs are adapted to receive said apertured member for locking the handle in either of its two pivotted positions.

7. A device according to claim 5, wherein said apertured member is slidable within a slot formed in the handle and is urged by a spring towards the operative peg.

8. A device according to claim 7, wherein said apertured member includes an apertured tongue movable within said slot in the handle, said handle including a rod receiving said apertured tongue for guiding the sliding movement of the apertured member in said slot, said spring being a coil spring enclosing said rod, one end of the spring bearing against said tongue and the opposite end of the spring bearing against the end wall of the slot in the handle.

9. A device according to claim 3, wherein said lock-pin assembly further includes a plate freely supported on said pin when the handle is in its initial position, said second cam surface of the pivotable handle being effective, in the pivoted position of the handle, to engage said plate to lock the pin assembly against inward axial movement further into the cavity.

10. A device according to claim 9, for use in coupling a container to a lifting device, wherein said slotted member is secured to the container, and said plate of the lock-pin assembly is a hanger plate having means for coupling same to the lifting device.

* * * * *